US011118443B2

(12) United States Patent
Shammeri

(10) Patent No.: US 11,118,443 B2
(45) Date of Patent: Sep. 14, 2021

(54) WELL COMPLETION SYSTEM FOR DUAL WELLBORE PRODUCER AND OBSERVATION WELL

(71) Applicant: Saudi Arabian Oil Company, Dhahran (SA)

(72) Inventor: Faleh Mudlah Shammeri, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 58 days.

(21) Appl. No.: 16/551,065

(22) Filed: Aug. 26, 2019

(65) Prior Publication Data

US 2021/0062637 A1 Mar. 4, 2021

(51) Int. Cl.
*E21B 47/00* (2012.01)
*E21B 34/12* (2006.01)
(Continued)

(52) U.S. Cl.
CPC ..... *E21B 47/00* (2013.01); *E21B 34/06* (2013.01); *E21B 34/12* (2013.01); *E21B 41/0035* (2013.01); *E21B 41/0042* (2013.01); *E21B 33/12* (2013.01); *E21B 43/10* (2013.01); *E21B 2200/04* (2020.05)

(58) Field of Classification Search
CPC .... E21B 34/12; E21B 7/061; E21B 2033/105; E21B 41/0035; E21B 41/0042
See application file for complete search history.

(56) References Cited

U.S. PATENT DOCUMENTS 4,846,281 A * 7/1989 Clary ..... E21B 43/045 166/373
5,388,648 A * 2/1995 Jordan, Jr. ..... E21B 7/061 166/117.5
(Continued)

FOREIGN PATENT DOCUMENTS

GB 2400620 A 10/2004
WO WO-9712112 A1 * 4/1997 ..... E21B 41/0035
(Continued)

OTHER PUBLICATIONS

B. Schwanitz, "Isolation Valve Contingencies Using Wireline Stroker and Tractor Technologies," SPE 124616, 2009, pp. 1-6.
(Continued)

*Primary Examiner* — Jennifer H Gay
(74) *Attorney, Agent, or Firm* — Bracewell LLP; Constance G. Rhebergen; Linda L. Morgan

(57) ABSTRACT

Methods and systems for producing hydrocarbons in a subterranean well with a completion system include landing an isolation valve completion within the subterranean well. The isolation valve completion is landed within an observation wellbore and downhole of a junction with a production wellbore. The isolation valve completion includes an isolation valve. A production tubing is delivered into the subterranean well. The production tubing has a downhole end located uphole of the junction with the production wellbore. An annulus defined between an outer diameter surface of the production tubing and an inner diameter surface of the subterranean well is sealed with a production packer that circumscribes the production tubing.

17 Claims, 5 Drawing Sheets

(51) Int. Cl.

| | |
|---|---|
| ***E21B 41/00*** | (2006.01) |
| ***E21B 33/12*** | (2006.01) |
| ***E21B 43/10*** | (2006.01) |
| ***E21B 34/06*** | (2006.01) |

(56) References Cited

U.S. PATENT DOCUMENTS

| | | | | |
|---|---|---|---|---|
| 5,402,851 | A | 4/1995 | Baiton | |
| 5,715,891 | A * | 2/1998 | Graham | E21B 41/0035 166/313 |
| 5,971,074 | A | 10/1999 | Longbottom et al. | |
| 6,092,601 | A * | 7/2000 | Gano | E21B 4/18 166/298 |
| 6,119,780 | A | 9/2000 | Christmas | |
| 6,237,683 | B1 | 5/2001 | Pringle et al. | |
| 6,915,847 | B2 * | 7/2005 | Brockman | E21B 41/0042 166/250.08 |
| 8,286,708 | B2 * | 10/2012 | Assal | E21B 23/06 166/313 |
| 8,800,652 | B2 * | 8/2014 | Bartko | E21B 47/107 166/250.1 |
| 8,826,991 | B2 * | 9/2014 | Steele | E21B 47/024 166/373 |
| 8,967,277 | B2 * | 3/2015 | Steele | E21B 47/024 166/380 |
| 9,140,102 | B2 * | 9/2015 | Bartko | E21B 47/12 |
| 9,249,559 | B2 * | 2/2016 | Dyer | E03B 3/14 |
| 9,416,638 | B2 * | 8/2016 | Zhou | E21B 34/10 |
| 9,540,917 | B2 | 1/2017 | Stone et al. | |
| 9,540,921 | B2 * | 1/2017 | Al-Ajaji | E21B 47/12 |
| 9,840,908 | B2 | 12/2017 | Patel et al. | |
| 9,951,573 | B2 * | 4/2018 | Dahl | E21B 23/01 |
| 10,132,159 | B2 * | 11/2018 | Burgos | E21B 47/07 |
| 10,731,417 | B2 * | 8/2020 | Vemuri | E21B 41/0042 |
| 2003/0066649 | A1 | 4/2003 | Koot et al. | |
| 2009/0071644 | A1 | 3/2009 | Themig | |
| 2010/0294512 | A1 * | 11/2010 | Assal | E21B 47/024 166/384 |
| 2012/0305266 | A1 * | 12/2012 | Steele | E21B 47/024 166/380 |
| 2013/0068453 | A1 * | 3/2013 | Al-Ajaji | E21B 47/12 166/254.2 |
| 2013/0081807 | A1 * | 4/2013 | Dyer | E03B 3/14 166/254.2 |
| 2013/0087321 | A1 * | 4/2013 | Bartko | E21B 41/0035 166/66 |
| 2013/0087325 | A1 * | 4/2013 | Bartko | E21B 47/107 166/250.1 |
| 2013/0175047 | A1 * | 7/2013 | Steele | E21B 17/04 166/373 |
| 2013/0327572 | A1 * | 12/2013 | Sponchia | E21B 7/06 175/61 |
| 2015/0369022 | A1 * | 12/2015 | Zhou | E21B 43/12 166/373 |
| 2016/0145956 | A1 * | 5/2016 | Dahl | E21B 7/061 166/382 |
| 2016/0186554 | A1 * | 6/2016 | Burgos | E21B 47/113 166/250.01 |
| 2018/0274300 | A1 * | 9/2018 | Vemuri | E21B 7/061 |
| 2019/0003258 | A1 | 1/2019 | Klam et al. | |
| 2019/0120021 | A1 * | 4/2019 | Steele | E21B 41/0035 |
| 2019/0128098 | A1 | 5/2019 | Ross et al. | |
| 2020/0149363 | A1 * | 5/2020 | Cho | E21B 23/006 |
| 2021/0062637 | A1 * | 3/2021 | Shammeri | E21B 34/12 |

FOREIGN PATENT DOCUMENTS

| | | | | |
|---|---|---|---|---|
| WO | WO-2008091155 | A1 * | 7/2008 | E21B 17/20 |
| WO | WO-2014190252 | A1 * | 11/2014 | E21B 47/135 |
| WO | 2017203292 | A1 | 11/2017 | |

OTHER PUBLICATIONS

International Search Report and Written Opinion for related PCT application PCT/US2020/047700 dated Oct. 28, 2020, pp. 1-14.

* cited by examiner

WELL COMPLETION SYSTEM FOR DUAL WELLBORE PRODUCER AND OBSERVATION WELL

BACKGROUND

1. Field of the Disclosure

The present disclosure relates in general to subterranean hydrocarbon development operations, and more particularly to completion systems for dual wellbore developments.

2. Description of the Related Art

In certain subterranean development operations it can be advantageous to produce fluids from a production zone with a lateral or horizontal well. An associated vertical or other portion of the wellbore can be used for observation purposes.

Such development configurations currently can include sliding doors and plugs which must be moved or retrieved in order to log either the production portion or the observation portion of the well. In such configurations, at least three runs into the subterranean well can be required to log either the production portion or the observation portion of the well.

As an example, in order to log the observation wellbore of some currently available systems, a run into the wellbore is needed to close the sliding door of the completion assembly. A second run into the well is required to retrieve the plug, and then the logging tool can be lowered into the observation wellbore. In order to log the production wellbore, a first run can be used to retrieve the isolation valve, a second run into the wellbore can set a deflection tool, and the third run can be used to log the production wellbore.

SUMMARY OF THE DISCLOSURE

Embodiments of this disclosure provide systems and methods for a completion for producing reservoir fluids from one wellbore and for separate isolation and entry into an observation wellbore for reservoir monitoring. The bottom of the production tubing string is located above the junction of the two wellbores. The observation wellbore is equipped with a mechanical formation isolation valve that is closed while the other wellbore is producing. The isolation valve can be opened using coiled tubing or wireline to conduct logging in the observation wellbore and then closed again upon job completion. This completion method also allows full logging access to the production wellbore.

In an embodiment of this disclosure, a method for producing hydrocarbons in a subterranean well with a completion system includes landing an isolation valve completion within the subterranean well. The isolation valve completion is landed within an observation wellbore and downhole of a junction with a production wellbore. The isolation valve completion includes an isolation valve. A production tubing is delivered into the subterranean well, the production tubing having a downhole end located uphole of the junction with the production wellbore. An annulus defined between an outer diameter surface of the production tubing and an inner diameter surface of the subterranean well is sealed with a production packer that circumscribes the production tubing.

In alternate embodiments, the method can further include moving the isolation valve from a closed position to an open position with a tubular string. The observation wellbore can be logged, and logging the observation wellbore can include only the steps of moving the isolation valve to an open position with a tubular string and running a logging tool into the observation wellbore. The method can further include after running the logging tool into the observation wellbore, returning the isolation valve to a closed position. Fluids can be produced from the production wellbore while logging the observation wellbore. Alternately, the subterranean well can be shut in while logging the observation wellbore.

In alternate embodiments of the disclosure, the method can further include logging the production wellbore, where logging the production wellbore includes a single trip into the production wellbore with a logging tool. Fluids can be produced from the production wellbore while logging the production wellbore. Alternately, the subterranean well can be shut in while logging the production wellbore.

In an alternate embodiment of this disclosure, an apparatus for producing hydrocarbons in a subterranean well with a completion system includes an isolation valve completion located within the subterranean well and having an isolation valve. The isolation valve completion is landed within an observation wellbore and downhole of a junction with a production wellbore. A production tubing extends into the subterranean well. The production tubing has a downhole end located uphole of the junction with the production wellbore. A production packer circumscribes the production tubing. The production packer seals across an uphole annulus defined between an outer diameter surface of the production tubing and an inner diameter surface of the subterranean well.

In alternate embodiments, a tubular string can extend into the subterranean well and can be operable to move the isolation valve from a closed position to an open position. A logging tool can extend through the isolation valve with the isolation valve in an open position, and into the observation wellbore. The logging tool can be operable to log the observation wellbore. Alternately, the logging tool can extend into the production wellbore and be operable to log the production wellbore.

In other alternate embodiments, a casing string can be located within the subterranean well, and the production tubing can extend within the casing string. The isolation valve completion can engage an inner diameter surface of the casing string. The isolation valve completion can further include a liner hanger. The liner hanger can support the isolation valve and have a hanger packer sealing across a downhole annulus defined between an outer diameter surface of the isolation valve completion and the inner diameter surface of the subterranean well. A tubing spool can extend between the liner hanger and the isolation valve.

BRIEF DESCRIPTION OF THE DRAWINGS

So that the manner in which the above-recited features, aspects and advantages of the disclosure, as well as others that will become apparent, are attained and can be understood in detail, a more particular description of the embodiments of the disclosure briefly summarized above may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The Specification, which includes the Summary of Disclosure, Brief Description of the Drawings and the Detailed Description, and the appended Claims refer to particular features (including process or method steps) of the disclosure. Those of skill in the art understand that the disclosure includes all possible combinations and uses of particular features described in the Specification. Those of skill in the art understand that the disclosure is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this disclosure relates unless defined otherwise.

As used in the Specification and appended Claims, the singular forms "a", "an", and "the" include plural references unless the context clearly indicates otherwise. As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Spatial terms describe the relative position of an object or a group of objects relative to another object or group of objects. The spatial relationships apply along vertical and horizontal axes. Orientation and relational words including "uphole" and "downhole"; "above" and "below" and other like terms are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the Specification and appended Claims to a method comprising two or more defined steps, the defined steps can be carried out in any order or simultaneously except where the context excludes that possibility.

Figure 1:
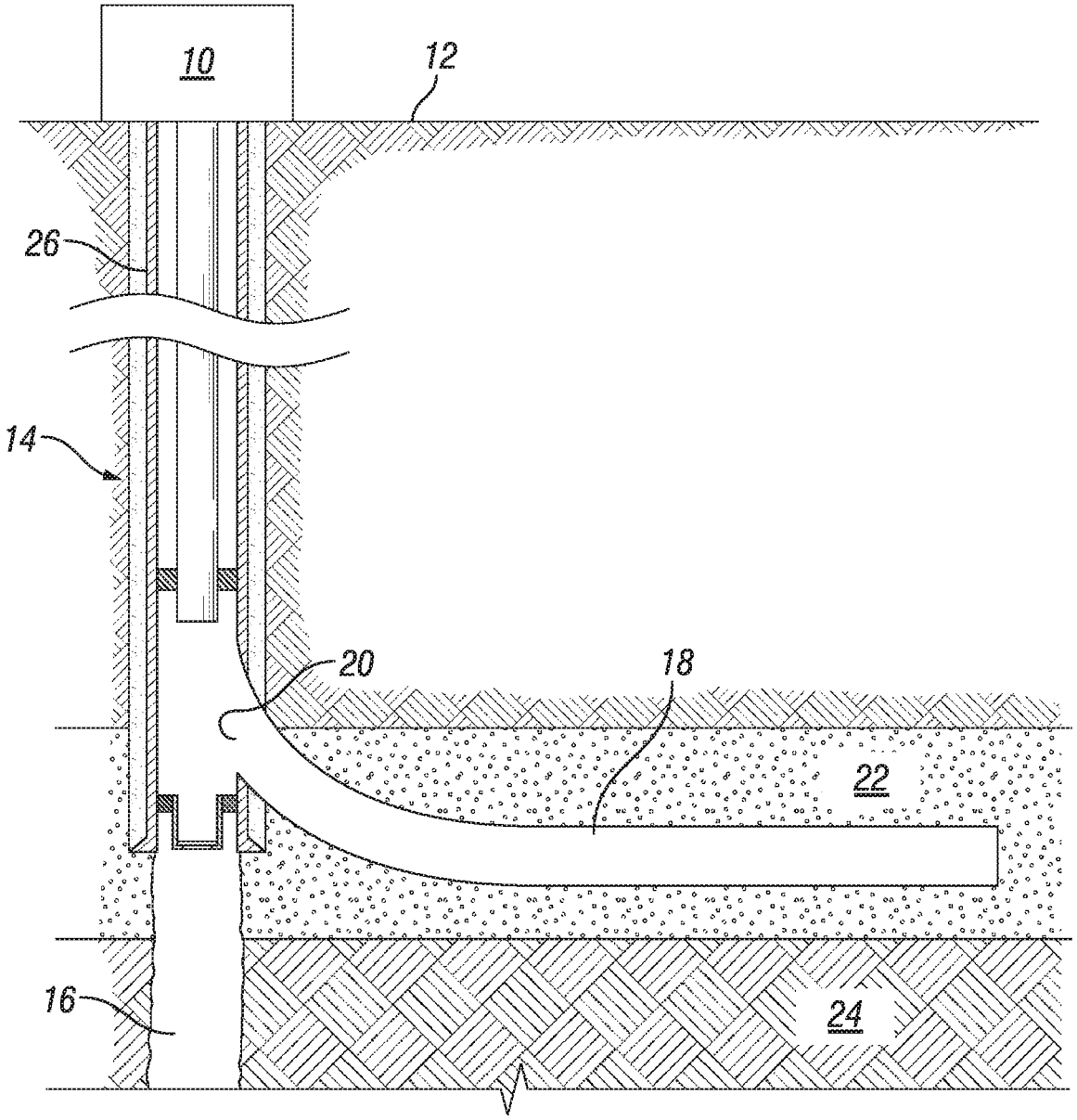
FIG. 1 is a schematic elevation view of a subterranean well with a completion system in accordance with an embodiment of this disclosure.

Looking at FIG. 1, a hydrocarbon production system may include surface tree 10 located at the earth's surface 12. Surface tree 10 could be situated on the earth's surface 12 that is subsea or on land. Subterranean well 14 can extend from earth's surface 12 into and through subterranean formations.

Subterranean well 14 can include a generally vertical well section 16 and a lateral well section 18, which meet at a sidetrack point at junction 20. A portion of the lateral well section 18 is located within the target production zone 22 and will allow for hydrocarbons within production zone 22 to be produced to surface tree 10. Lateral well section 18 may be, for example, a horizontal well or include a wellbore that is otherwise inclined from vertical. Vertical well section 16 passes through production zone 22 and into a lower zone 24. Vertical well section 16 can be used to observe conditions both in production zone 22 and the lower zone 24, which is an observation zone.

Vertical well section 16 can be drilled, and cased to a certain depth with casing string 26. A downhole end of casing string 26 can extend downhole of junction 20. Vertical well section 16 can be substantially vertical, or can be somewhat inclined from vertical, but inclined less-so that lateral well section 18.

Lateral well section 18 can be drilled by conventional means to extend from vertical well section 16. Lateral well section 18 can be an open or uncased hole. Alternately, lateral well section 18 can be cased, include a drop-off liner completion, or can be completed in an alternate known manner.

Figure 2:
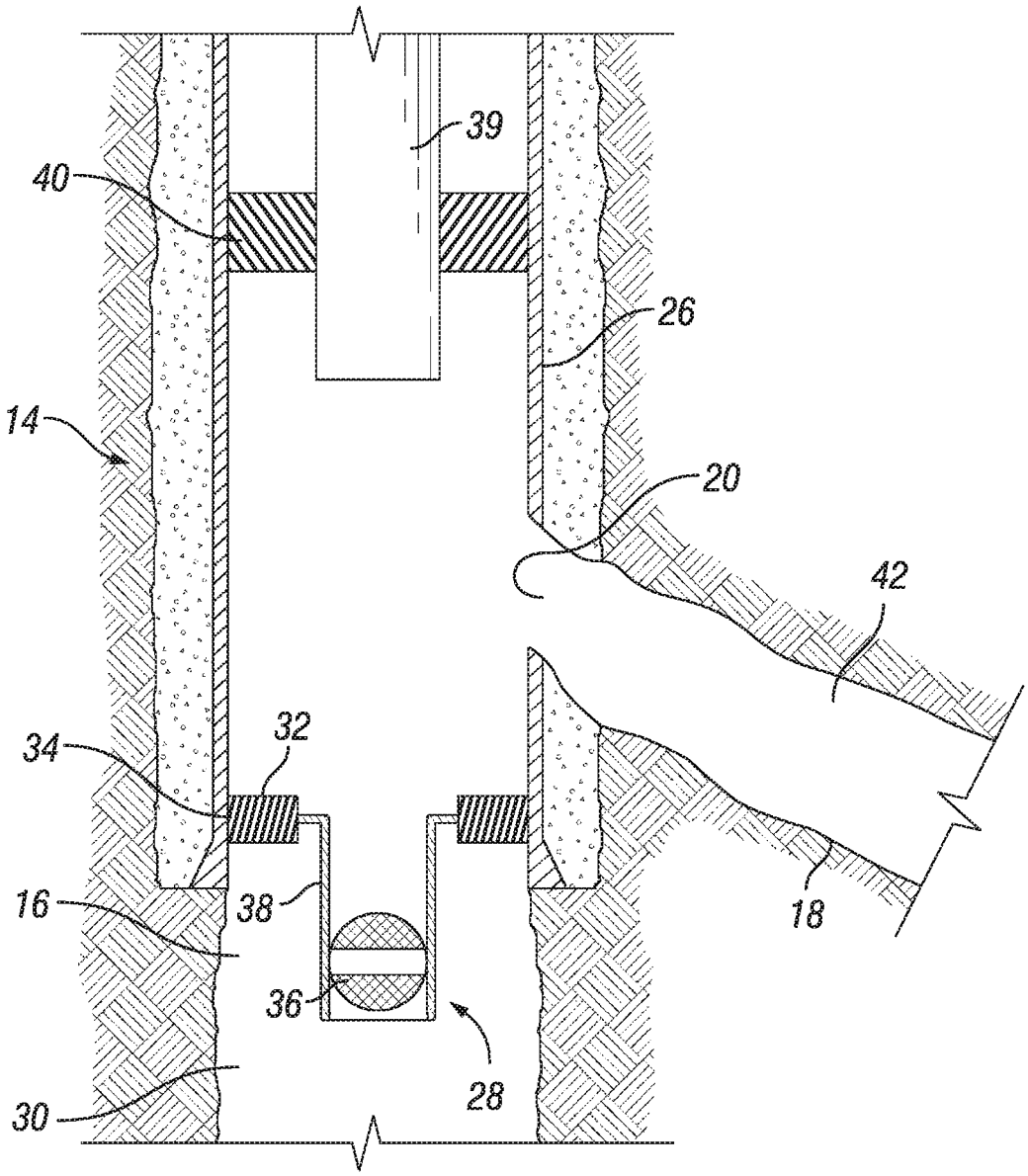
FIG. 2 is a detailed elevation view of a completion system, in accordance with an embodiment of this disclosure, shown with the isolation valve in a closed position.

Looking at FIG. 2, isolation valve completion 28 can be located within subterranean well 14. Isolation valve completion 28 can be located within observation wellbore 30, which can be a portion of vertical well section 16 downhole from junction 20. Isolation valve completion 28 can be landed within observation wellbore 30 at a location downhole of junction 20.

Isolation valve completion 28 can engage an inner diameter surface of casing string 26. Isolation valve completion 28 can include liner hanger 32. Liner hanger 32 can support isolation valve completion 28 within subterranean well 14. Liner hanger 32 can include hanger packer 34. Hanger packer 34 seals across a downhole annulus defined between an outer diameter surface of isolation valve completion 28 and the inner diameter surface of subterranean well 14. Hanger packer 34 can seal against the inner diameter surface of casing string 26. Hanger packer 34 can prevent fluids from passing through the downhole annulus defined between the outer diameter surface of isolation valve completion 28 and the inner diameter surface of subterranean well 14. When hanger packer 34 is sealingly engaged against the inner diameter surface of casing string 26 and isolation valve 36 is in the closed position, fluids cannot pass between uphole of isolation valve completion 28 and downhole of isolation valve completion 28.

Figure 3:
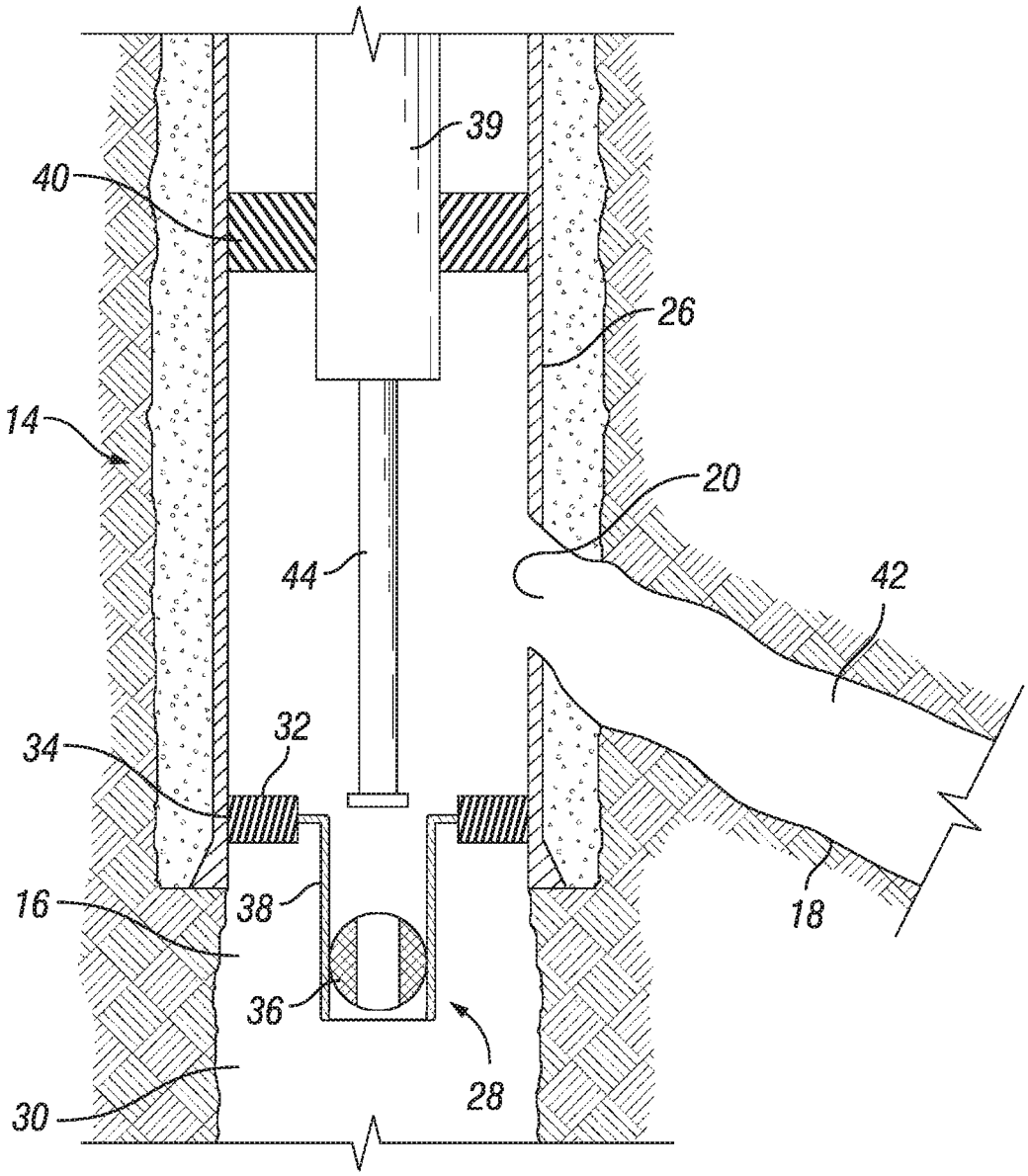
FIG. 3 is a detailed elevation view of a completion system, in accordance with an embodiment of this disclosure, shown with the isolation valve in an open position.

Isolation valve completion 28 can further include isolation valve 36. Isolation valve 36 can be a mechanical formation isolation valve such as, for example, a flapper or ball type valve. Isolation valve 36 can move between a closed position (FIG. 2) and an open position (FIG. 3). When isolation valve 36 is in the closed position, fluid is prevented from passing through isolation valve completion 28. When isolation valve 36 is in the open position, fluid, tools, and equipment can pass through isolation valve completion 28 by way of isolation valve 36. Observation wellbore 30 can contain an inhibiting fluid that applies sufficient hydrostatic pressure within observation wellbore 30 so that when isolation valve 36 is in an open position, a minimal amount of fluids or no fluids from within observation wellbore 30 will travel uphole through isolation valve 36.

Figure 4:
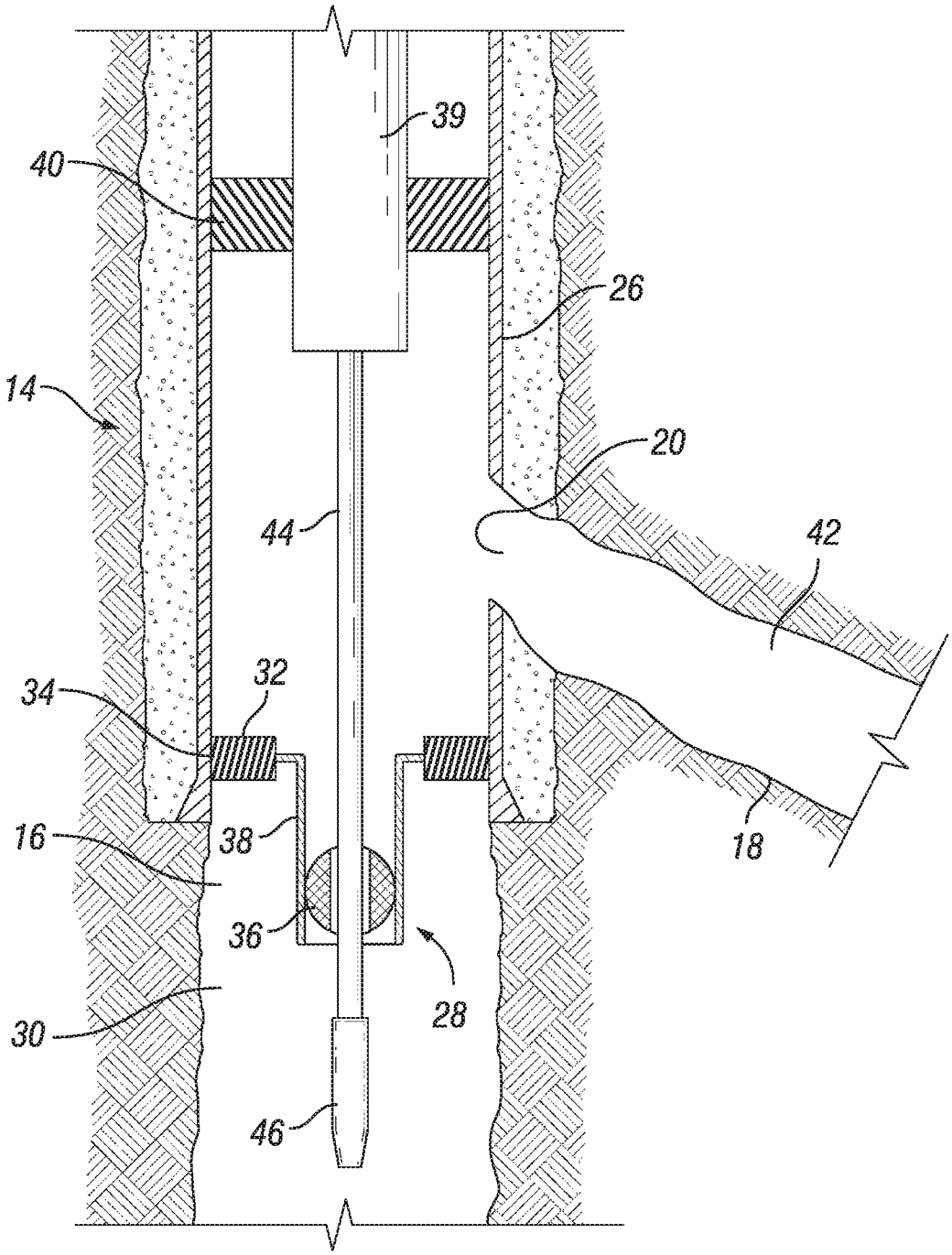
FIG. 4 is a detailed elevation view of a completion system, in accordance with an embodiment of this disclosure, shown with a logging tool in the observation wellbore.

In the example configurations of FIGS. 2-4, a ball type valve is shown. When isolation valve 36 is in the closed position as shown in FIG. 2, the ball member of ball type valve is positioned so that an opening through the ball member is unaligned with a bore of tubing spool 38. In the closed position, fluid is prevented from passing through isolation valve completion 28. When isolation valve 36 is in the open position as shown in FIG. 3, the ball member of ball type valve is positioned so that the opening through the ball member is aligned with the bore of tubing spool 38. In the open position, the opening through the ball member allows fluid, tools, and equipment to pass through isolation valve completion 28.

When isolation valve 36 is a flapper type valve, when isolation valve 36 is in the closed position the flap is oriented to prevent fluid from passing through isolation valve completion 28. When isolation valve 36 is in the open position, the flap is oriented to allow fluid, tools, and equipment to pass through isolation valve completion 28.

Isolation valve completion 28 can further include tubing spool 38. Tubing spool 38 extends between hanger packer 34 and isolation valve 36.

Production tubing 39 extends into subterranean well 14. Production tubing 39 can extend within casing string 26. Production tubing 39 has a downhole end that is located uphole of junction 20. Lateral well section 18 can be a production wellbore 42. Fluids from production wellbore 42 can be produced through production tubing 39 to surface tree 10 (FIG. 1).

Production packer 40 circumscribes production tubing 39, sealing across an uphole annulus defined between an outer diameter surface of production tubing 39 and an inner diameter surface of subterranean well 14. Production packer 40 can seal against an inner diameter surface of casing string 26 uphole of junction 20.

Looking at FIG. 3, tubular string 44 can be used to move isolation valve 36 from the closed position to the open position. Tubular string 44 can be for example, coiled tubing or a wire line with a tool located at a downhole end. In alternate embodiments, a tractor tool could be used to move isolation valve 36 from the closed position to the open position. Tubular string 44 can be lowered through production tubing 39 to engage isolation valve completion 28 and move isolation valve 36 to the open position.

Looking at FIG. 4, with isolation valve 36 in the open position, observation wellbore 30 can be logged. Logging tool 46 can be lowered through production tubing 39 and run into observation wellbore 30 through isolation valve 36. Therefore, in order to log observation wellbore 30, the only trips into the well that are required is a first run to move isolation valve 36 to an open position and a second run with the logging tool. During the logging of observation wellbore 30, fluids from production wellbore 42 can continue being produced through production tubing 39 to surface tree 10. Alternately, during the logging of observation wellbore 30, subterranean well 14 can be shut in from the surface at surface tree 10. After observation wellbore 30 has been logged, isolation valve 36 can be returned to the closed position with tubular string 44.

Figure 5:
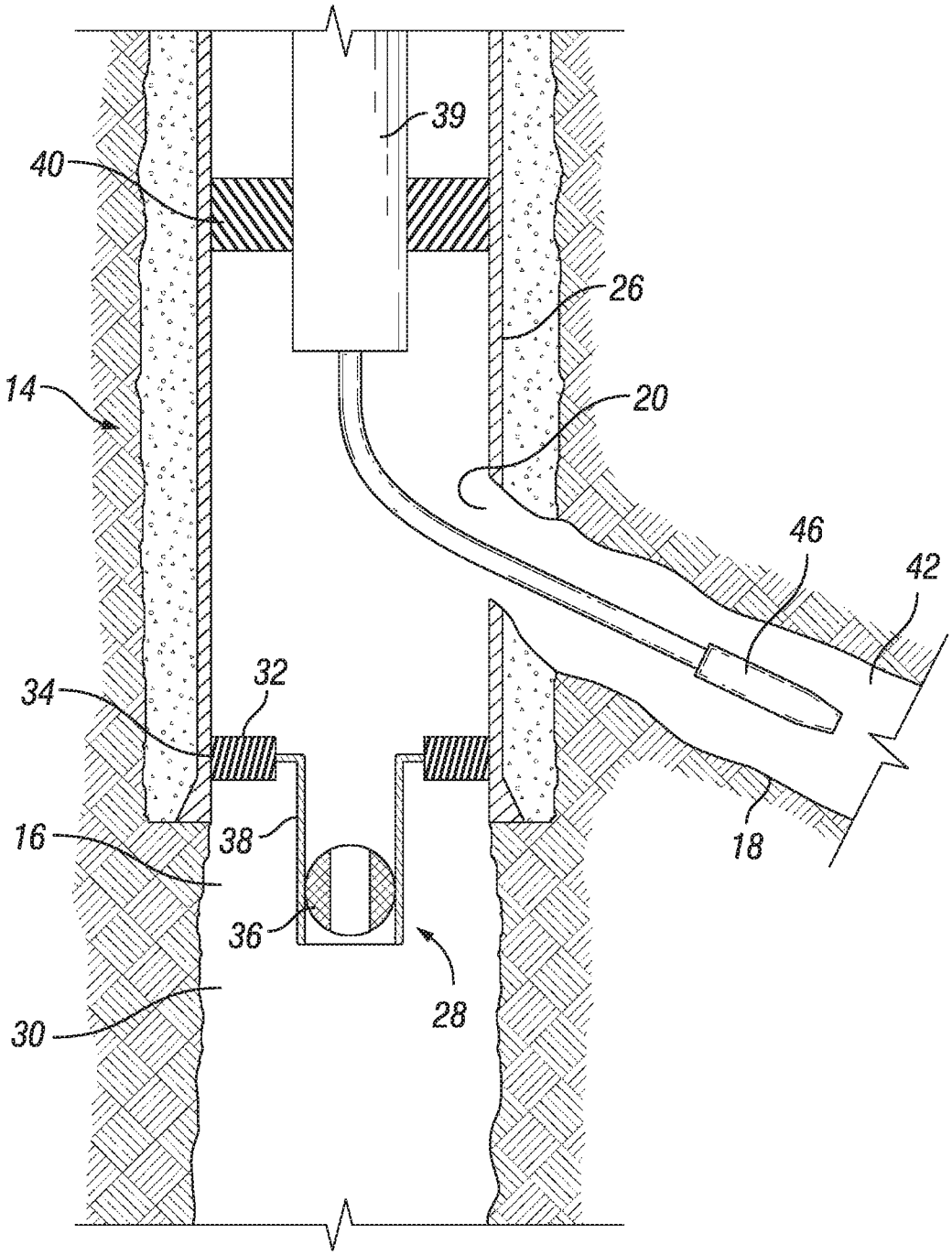
FIG. 5 is a detailed elevation view of a completion system, in accordance with an embodiment of this disclosure, shown with a logging tool in the production wellbore.

Looking at FIG. 5, with isolation valve 36 in the closed position, production wellbore 42 can be logged. Logging tool 46 can be lowered through production tubing 39 and run into production wellbore directly. Logging tool 46 can include a multi-lateral tool that can be signaled to rotate to the required angle when logging tool 46 reaches junction 20, to direct logging tool 46 into production wellbore 42. Therefore, in order to log production wellbore 42, the only trip into the well that is required is a single run with logging tool 46. During the logging of production wellbore 42, fluids from production wellbore 42 can continue being produced through production tubing 39 to surface tree 10. Alternately, during the logging of production wellbore 42, subterranean well 14 can be shut in from the surface at surface tree 10.

In an example of operation, after drilling observation wellbore 30 and production wellbore 42, isolation valve completion 28 can be landed within observation wellbore 30 downhole of junction 20. Production tubing 39 can be delivered into subterranean well 14 such that the downhole end of production tubing 39 is located uphole of junction 20. The annulus defined between the outer diameter surface of production tubing 39 and the inner diameter of subterranean well 14 can be sealed with production packer 40.

In order to log observation wellbore 30, tubular string 44 is lowered through production tubing 39 to engage isolation valve completion 28 and move isolation valve 36 to the open position. Logging tool 46 is then lowered through production tubing 39 and through isolation valve 36 to reach observation wellbore 30 downhole of isolation valve completion 28. After observation wellbore 30 has been logged, isolation valve 36 can be moved back to the closed position.

In order to log the production wellbore 42, logging tool 46 is lowered through production tubing 39 to reach production wellbore 42.

Systems and methods of this disclosure therefore provide an effective completion design for producing reservoir fluids from one wellbore, and separate isolation and entry to an observation wellbore for reservoir monitoring. This completion method also allows full logging access to the production wellbore. This well completion design is simpler and less costly than currently available dual bore completions.

Embodiments described herein, therefore, are well adapted to carry out the objects and attain the ends and advantages mentioned, as well as others inherent therein. While certain embodiments have been described for purposes of disclosure, numerous changes exist in the details of procedures for accomplishing the desired results. These and other similar modifications will readily suggest themselves to those skilled in the art, and are intended to be encompassed within the scope of the present disclosure disclosed herein and the scope of the appended claims.

What is claimed is:

1. A method for producing hydrocarbons in a subterranean well with a completion system, the method including:

landing an isolation valve completion within the subterranean well, the isolation valve completion being landed within an observation wellbore and downhole of a junction with a production wellbore and including an isolation valve, where the observation wellbore is a vertical section of the subterranean well that passes through a production zone and into a lower zone, and where the production wellbore is lateral well section with a portion located within the production zone;

delivering a production tubing into the subterranean well, the production tubing having a terminal downhole end located uphole of the junction with the production wellbore so that the subterranean well is free of any portion of an inner tubular member from uphole of the junction with the production wellbore and extending past the junction with the production wellbore to downhole of the junction with the production wellbore; and sealing across an annulus defined between an outer diameter surface of the production tubing and an inner diameter surface of the subterranean well with a production packer that circumscribes the production tubing.

2. The method of claim 1, where the method further includes moving the isolation valve from a closed position to an open position with a tubular string.

3. The method of claim 1, further including logging the observation wellbore, where logging the observation wellbore includes only steps of moving the isolation valve to an open position with a tubular string and running a logging tool into the observation wellbore.

4. The method of claim 3, where logging the observation wellbore further includes after running the logging tool into the observation wellbore, logging the observation wellbore with the logging tool, retrieving the logging tool from the observation wellbore, and returning the isolation valve to a closed position with the tubular string.

5. The method of claim 3, further including producing fluids from the production wellbore while logging the observation wellbore.

6. The method of claim 3, further including shutting in the subterranean well while logging the observation wellbore.

7. The method of claim 1, further including logging the production wellbore, where logging the production wellbore includes a single trip into the production wellbore with a logging tool.

8. The method of claim 7, further including producing fluids from the production wellbore while logging the production wellbore.

9. The method of claim 7, further including shutting in the subterranean well while logging the production wellbore.

10. A system for producing hydrocarbons in a subterranean well with a completion system, the system including:

an isolation valve completion located within the subterranean well and having an isolation valve, the isolation valve completion being landed within an observation wellbore and downhole of a junction with a production wellbore, where the observation wellbore is a vertical section of the subterranean well that passes through a production zone and into a lower zone, and where the production wellbore is lateral well section with a portion located within the production zone;

a production tubing extending into the subterranean well, the production tubing having a terminal downhole end located uphole of the junction with the production wellbore so that the subterranean well is free of any portion of an inner tubular member from uphole of the junction with the production wellbore and extending past the junction with the production wellbore to downhole of the junction with the production wellbore; and a production packer that circumscribes the production tubing, the production packer sealing across an uphole annulus defined between an outer diameter surface of the production tubing and an inner diameter surface of the subterranean well.

11. The system of claim 10, further including a tubular string extending into the subterranean well and operable to move the isolation valve from a closed position to an open position.

12. The system of claim 10, further including a logging tool extending through the isolation valve with the isolation valve in an open position, and into the observation wellbore, the logging tool operable to log the observation wellbore.

13. The system of claim 10, further including a logging tool extending into the production wellbore, the logging tool operable to log the production wellbore.

14. The system of claim 10, further including a casing string located within the subterranean well, and where the production tubing extends within the casing string.

15. The system of claim 14, where the isolation valve completion engages an inner diameter surface of the casing string.

16. The system of claim 10, where the isolation valve completion further includes a liner hanger, the liner hanger supporting the isolation valve and having a hanger packer sealing across a downhole annulus defined between an outer diameter surface of the isolation valve completion and the inner diameter surface of the subterranean well.

17. The system of claim 16, where the isolation valve completion further includes a tubing spool extending between the liner hanger and the isolation valve.

* * * * *